US007923908B2

(12) United States Patent
Lapatovich

(10) Patent No.: US 7,923,908 B2
(45) Date of Patent: Apr. 12, 2011

(54) METAL HALIDE REFLECTOR LAMP WITH BEAM COLOR HOMOGENIZER

(75) Inventor: Walter P. Lapatovich, Boxford, MA (US)

(73) Assignee: Osram Sylvania Inc., Danvers, MA (US)

( * ) Notice: Subject to any disclaimer, the term of this patent is extended or adjusted under 35 U.S.C. 154(b) by 643 days.

(21) Appl. No.: 11/862,234

(22) Filed: Sep. 27, 2007

(65) Prior Publication Data

US 2009/0085455 A1 Apr. 2, 2009

(51) Int. Cl.
*H01J 5/48* (2006.01)
*H01J 5/50* (2006.01)
*H01K 1/26* (2006.01)

(52) U.S. Cl. ..... 313/113; 313/318.11; 313/634; 313/637; 313/638; 313/489; 362/263; 362/268

(58) Field of Classification Search ..... 313/113, 313/573, 634
See application file for complete search history.

(56) References Cited

U.S. PATENT DOCUMENTS

| | | | | |
|---|---|---|---|---|
| 4,935,660 | A * | 6/1990 | Heider et al. | 313/25 |
| 5,081,564 | A * | 1/1992 | Mizoguchi et al. | 362/521 |
| 5,187,412 | A | 2/1993 | El-Hamamsy et al. | |
| 5,272,407 | A * | 12/1993 | Tillman et al. | 313/25 |
| 5,287,101 | A * | 2/1994 | Serizawa | 340/815.76 |
| 5,610,469 | A * | 3/1997 | Bergman et al. | 313/25 |
| 6,352,359 | B1 * | 3/2002 | Shie et al. | 362/522 |
| 6,536,918 | B1 | 3/2003 | Boroczki et al. | |
| 2003/0193280 | A1 | 10/2003 | Lapatovich et al. | |
| 2004/0056599 | A1 * | 3/2004 | Brock | 313/634 |
| 2004/0257813 | A1 * | 12/2004 | Takezawa | 362/267 |
| 2005/0036314 | A1 | 2/2005 | Kobayashi et al. | |
| 2005/0184632 | A1 | 8/2005 | Galvez et al. | |
| 2005/0212435 | A1 | 9/2005 | Wei et al. | |
| 2005/0264878 | A1 | 12/2005 | Plummer et al. | |
| 2006/0171158 | A1 * | 8/2006 | Hendricx et al. | 362/509 |

FOREIGN PATENT DOCUMENTS

JP 60131957 * 9/1985

OTHER PUBLICATIONS

U.S. Appl. No. 11/511,832, filed Aug. 29, 2006.

* cited by examiner

*Primary Examiner* — Sikha Roy
(74) *Attorney, Agent, or Firm* — Robert F. Clark

(57) ABSTRACT

A novel metal halide reflector lamp is described wherein the reflector lamp has a passive optical element to scramble, color mix, and otherwise commingle the light emitted by the metal halide burner. The optical element is placed close to the radiating plasma volume to intercept a large solid angle. Preferably, the optical element substantially intercepts the emitted light within a solid angle that has its vertex at the center of the discharge volume of the burner and is subtended by the open end of the reflector. The optical element can be designed to scatter, reflect or refract the light emanating in this solid angle which otherwise would not impinge on the primary optical control surface of the reflector.

21 Claims, 6 Drawing Sheets

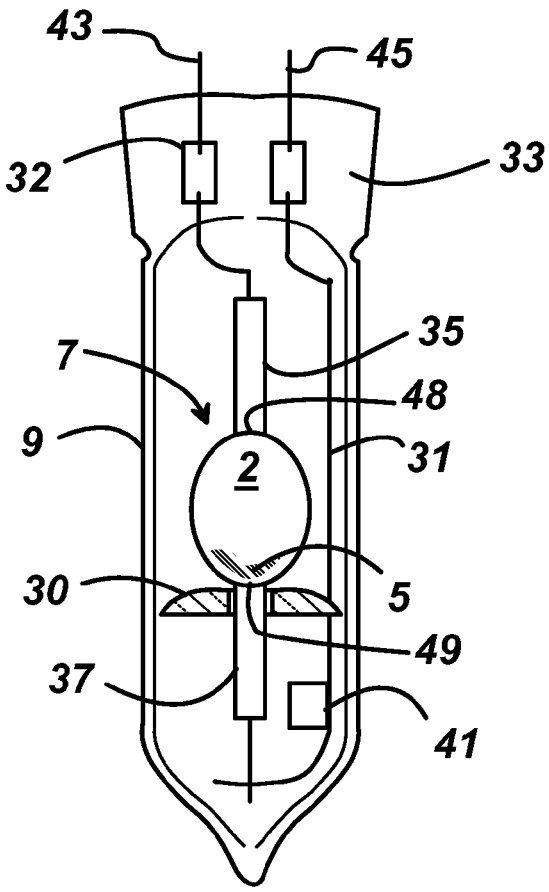
Fig. 5a
Fig. 5b
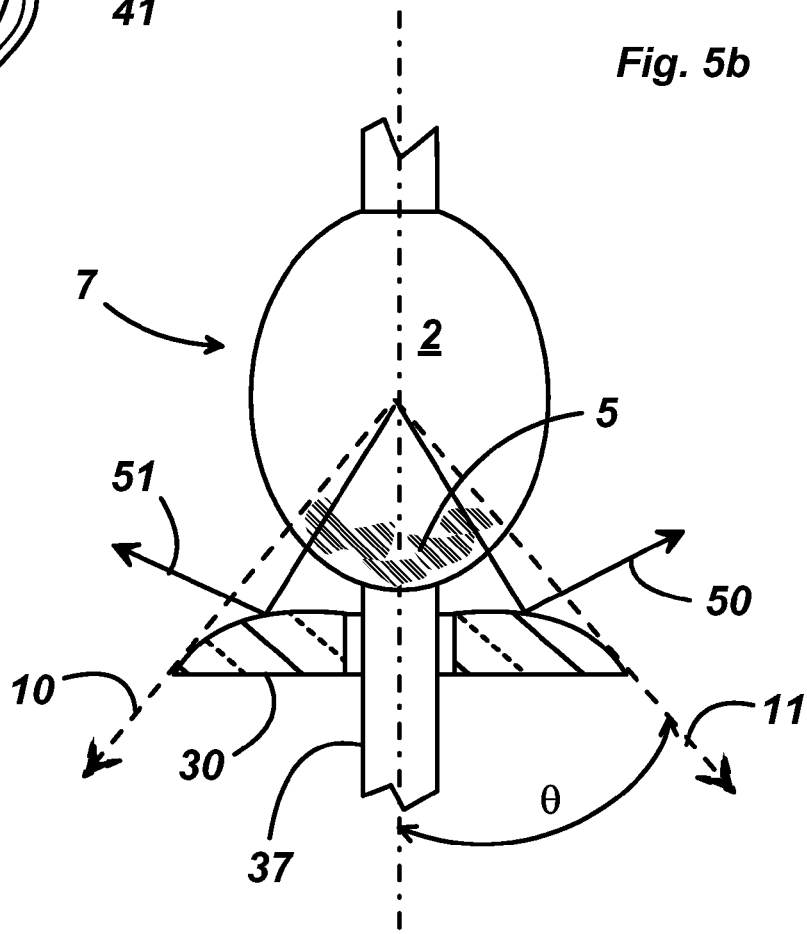

METAL HALIDE REFLECTOR LAMP WITH BEAM COLOR HOMOGENIZER

TECHNICAL FIELD

The instant invention pertains to metal halide lamps, and, more particularly to metal halide lamps enclosed in a reflective optic. Such applications include, but are not limited to spot and flood illumination, highlighting objects de art, merchandise and facade illumination, and other general illumination applications.

BACKGROUND OF THE INVENTION

Low wattage quartz metal halide and miniature ceramic metal halide (HCl) lamps have been on the market for some time. These lamps are designed to be small concentrated sources of light for inclusion into reflectors for down-lighting and concentrated illumination (spots or floods). A key advantage offered by these lamps is the potential replacement of tungsten-halogen PAR or AR reflector lamps with more energy efficient metal halide lamps while preserving good color rendition, and uniform beam color. Examples of these types of lamps are described in U.S. Patent Publication Nos. 2003/0193280 and 2005/0184632.

However, metal halide lamps in reflector applications tend to exhibit strong color variations in the far field beam which are undesirable and essentially absent in tungsten-halogen PAR lamps. These color variations occur because of segregation in the electric arc of the radiating species, absorption of the salts on the burner interior surface and radiation escaping from the burner which does not impinge on the primary optical control surface. This color separation is somewhat mitigated by the use of dappled glass lenses over the output aperture of the reflector and swirl lines on the interior of the reflector. Still, it would be an advantage to improve the homogenization of the color of the emitted light across the beam pattern of the lamp.

SUMMARY OF THE INVENTION

It is an object of the invention to obviate the disadvantages of the prior art

It is another object of the invention to provide better color uniformity in the projected beam of a metal halide reflector lamp.

In accordance with an object of the invention, there is provided a novel metal halide reflector lamp having a passive optical element to scramble, color mix, and otherwise commingle the light emitted by the metal halide burner. The optical element is placed close to the radiating plasma volume to intercept a large solid angle. Preferably, the optical element substantially intercepts the emitted light within a solid angle that has its vertex at the center of the discharge volume of the burner and is subtended by the open end of the reflector. The optical element can be designed to scatter, reflect or refract the light emanating in this solid angle which otherwise would not impinge on the primary optical control surface of the reflector. Without the optical element, the light emitted within the solid angle does not interact with the reflector facets or swirls and cannot be color mixed with the light from other solid angles.

The optical element of the instant invention can be made of quartz, molded and sintered polycrystalline alumina (PCA), sapphire for transparent objects, or any of the other translucent/transparent ceramics such as aluminum nitride, aluminum oxynitride, or yttrium aluminum garnet. The only requirement is that it not chemically react with the lamp components, or crack at operation temperature.

BRIEF DESCRIPTION OF THE DRAWINGS

FIGS. 5*a* and 5*b* are illustrations showing the placement of the optical element in a ceramic metal halide lamp.

DETAILED DESCRIPTION OF THE INVENTION

For a better understanding of the present invention, together with other and further objects, advantages and capabilities thereof, reference is made to the following disclosure and appended claims taken in conjunction with the above-described drawings.

Figure 1:
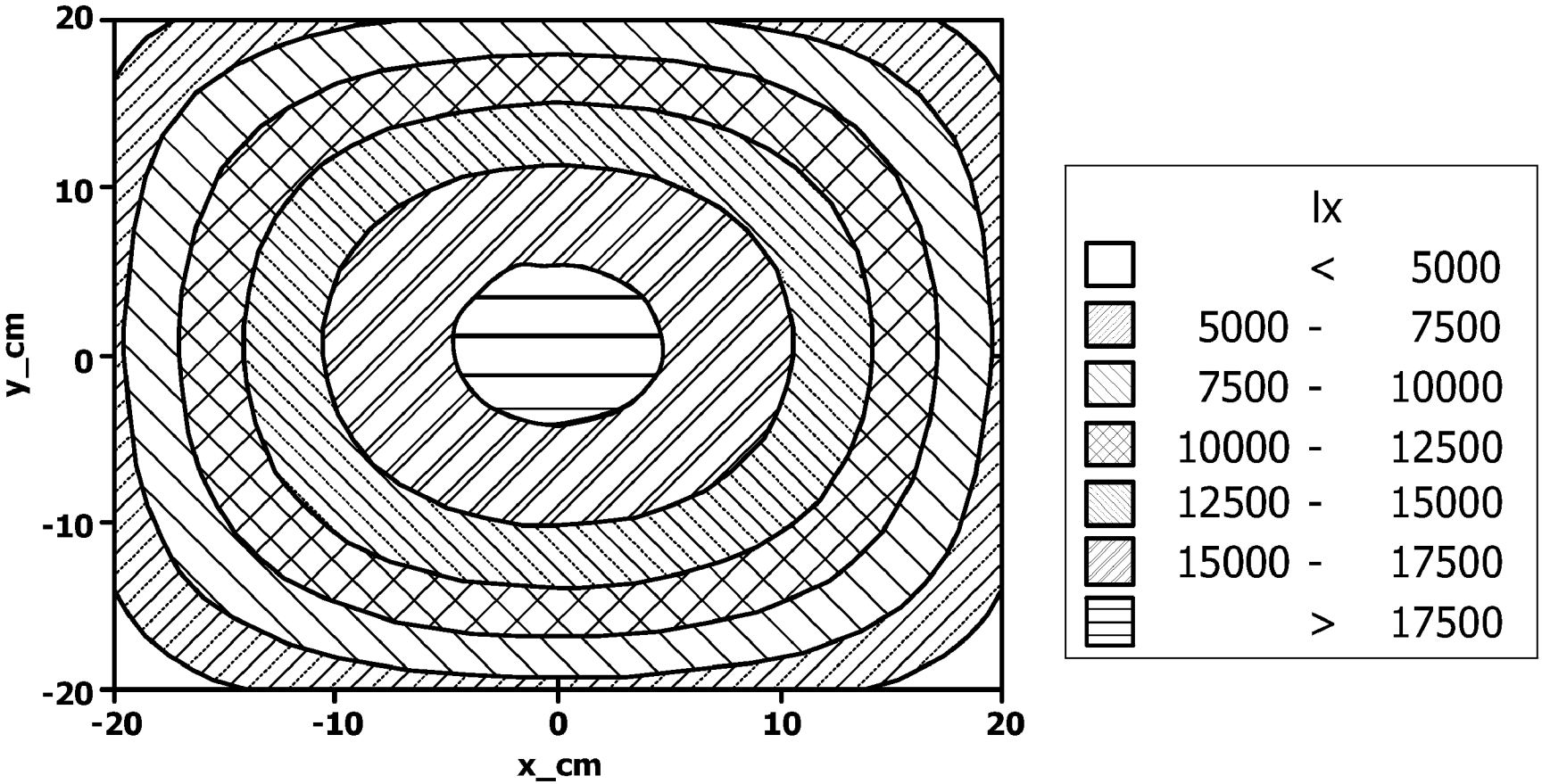
FIG. 1 is a plot of the measured distribution of illuminance on a target screen placed at 1.6 m from a 70 W HCl burner in a PAR 38 reflector lamp.
Figure 2:
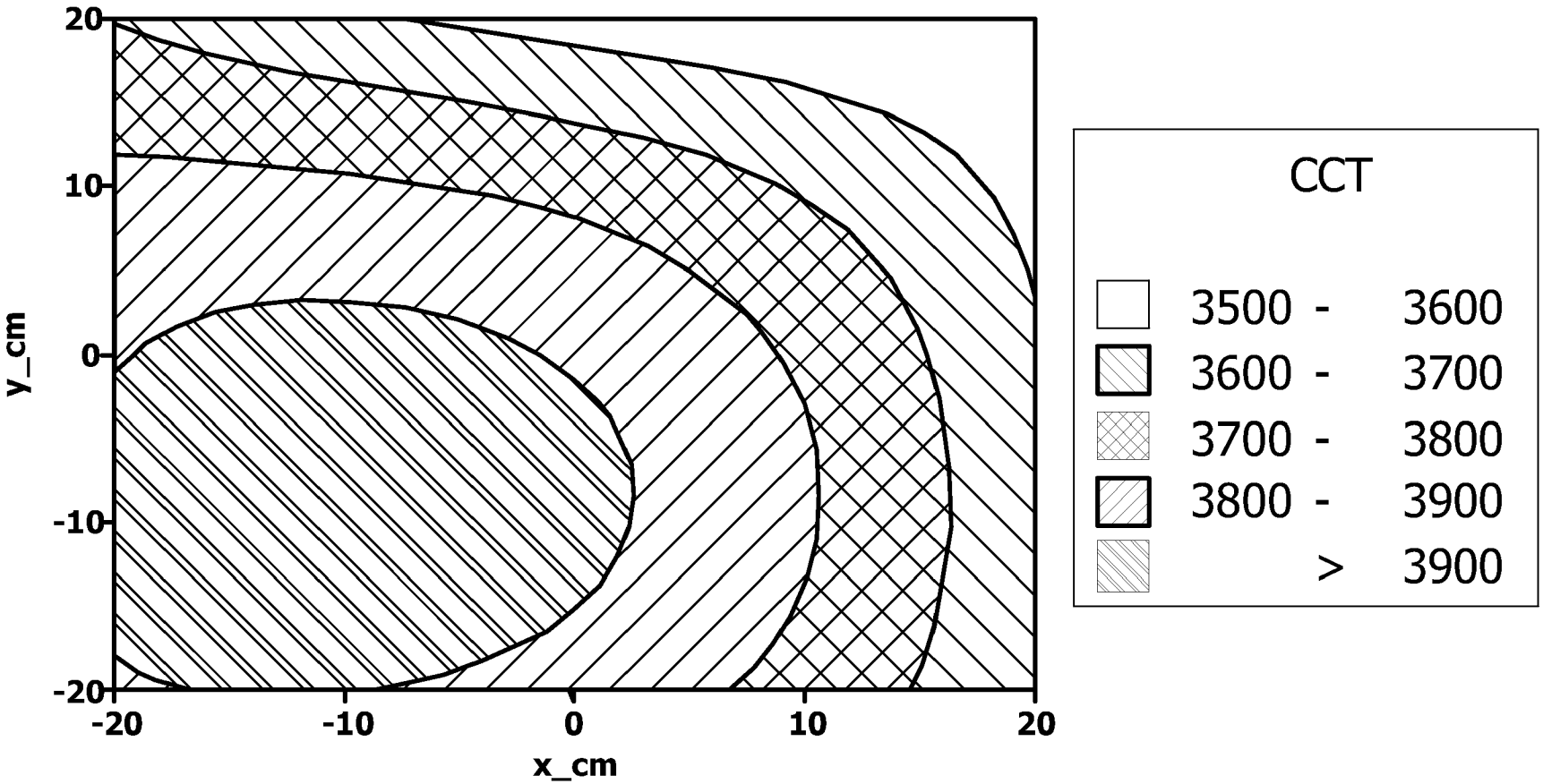
FIG. 2 (Prior Art)
FIG. 2 is a plot of the measured spatial color temperature distribution of the light emitted from a horizontally burning 70 W HCl burner in a PAR 38 reflector lamp.

FIG. 1 shows the isolux lines measured for a 70 W HCl PAR38 lamp burning horizontally and projected onto a screen 1.6 m away. As shown, the luminous intensity should decrease uniformly outward from the center (>17500 lx (lumens/$m^2$)) of the beam pattern. However, existing metal halide reflector lamps exhibit a color non-uniformity over this field, particularly when operated in other than a vertical, base-up orientation. The non-uniformity in the correlated color temperature (CCT) for a horizontally operated 70 W HCl PAR38 lamp is shown in FIG. 2. The CCT metric displayed in FIG. 2 is a common metric used to describe the color of the light emitted by a lamp. Another less commonly used metric is to map the CIE chromaticity coordinates (x,y) using the 1931 or 1976 systems.

Figure 3B:
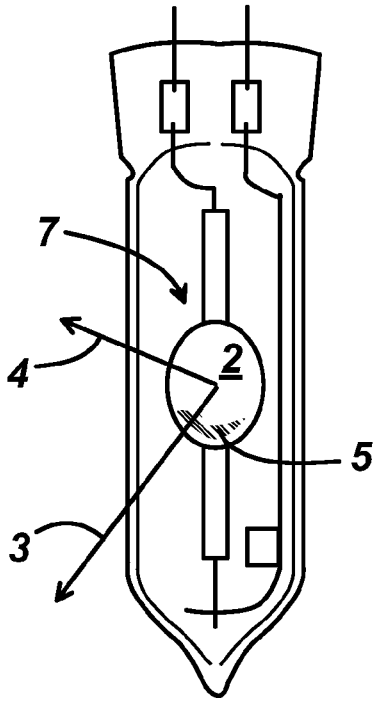
Fig. 3b (Prior Art)
FIGS. 3*a* and 3*b* are illustrations of a prior art ceramic metal halide reflector lamp (FIG. 3*a*) and an enlarged view of its jacketed ceramic burner (FIG. 3*b*).
Figure 3A:
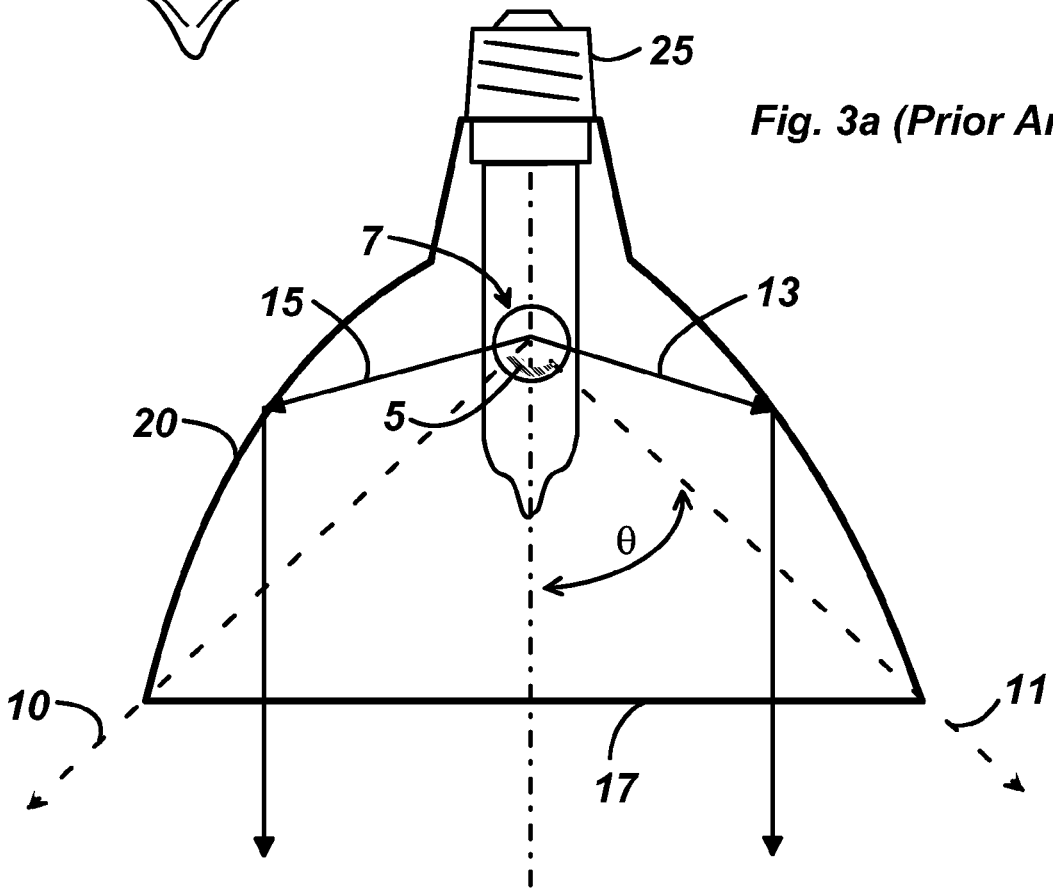
Fig. 3a (Prior Art)
Figure 4:
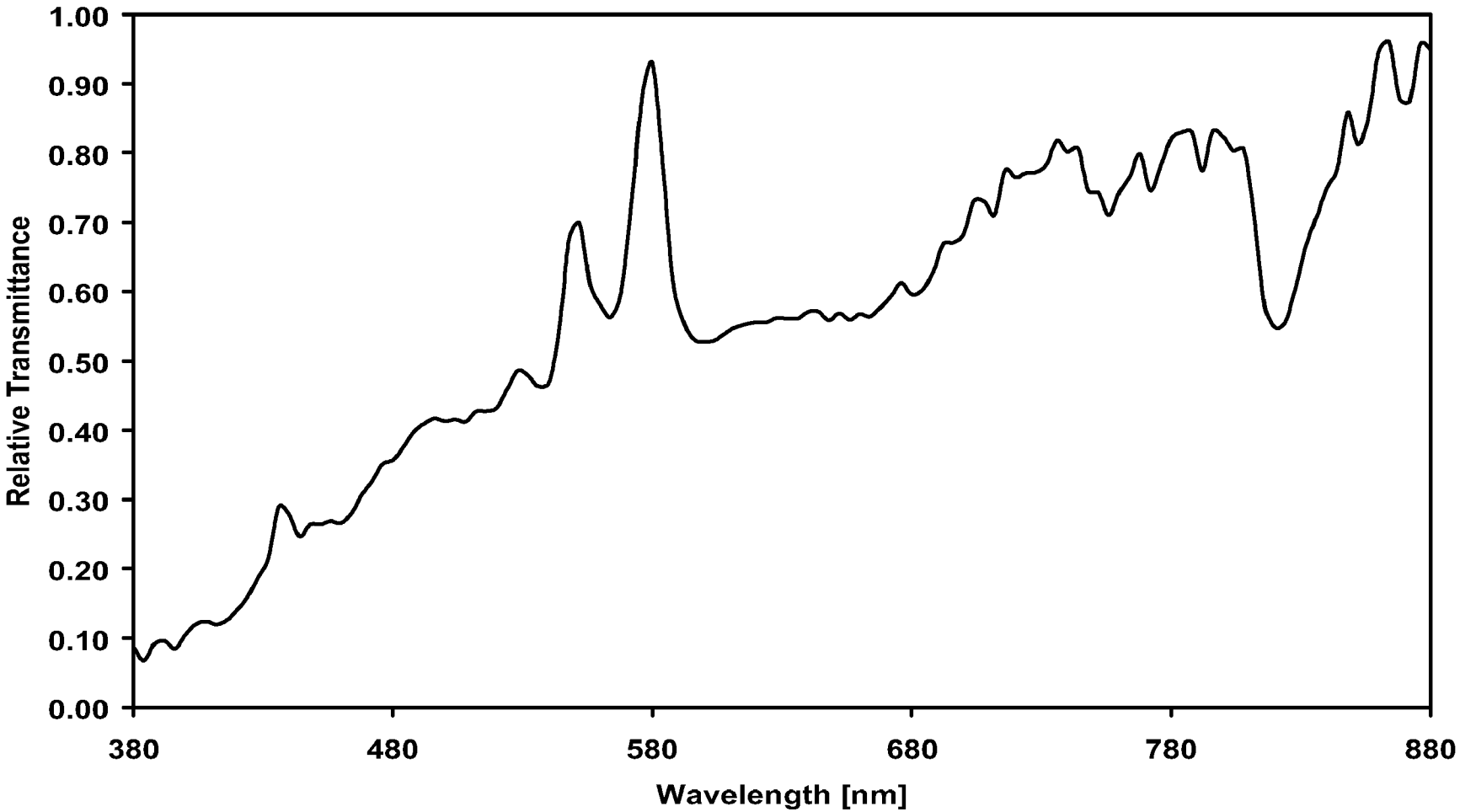
FIG. 4 shows a ratio of spectral radiance of light passing through a salt droplet to light passing through the wall of a polycrystalline alumina burner.

The non-uniformity of the metal halide reflector lamps has its roots in the color separation mechanisms described above and may be understood by reference to FIGS. 3*a* and 3*b*. In particular, FIG. 3*a* illustrates how the irregular and uncontrollable positioning of the salt melt pool 5 can affect the light emanating from the discharge volume 2 of burner 7 especially in the isolated solid angle, $d\Omega=2\pi(1-\cos\theta)$, as defined by polar angle, $\theta$. Unlike the light emitted in directions 13, 15, light emitted from the burner 7 in the solid angle (shown delimited by dashed arrows 10, 11) does not impinge on the primary optical control surface, viz. the reflector 20. Any color variation within this uncontrolled solid angle cannot be easily mixed with the light from the rest of the burner prior to exiting the open end 17 of reflector 20. In fact, when the arc radiation passes through the salt pool (as shown by arrow 3 in FIG. 3*b*), the radiation is strongly filtered, as the salts absorb preferentially in the near UV and blue. Consequently light from the isolated solid angle $d\Omega$ can be reddish yellow. This is illustrated in FIG. 4 which shows the absorption of the salt pool for a typical 3000K rare earth salt blend. In particular, FIG. 4 shows a ratio of spectral radiance of light passing through a salt droplet to light passing through the wall of a polycrystalline alumina burner (as indicated by arrow 4 in FIG. 3*b*). This preferential wavelength absorption may have the effect of making objects in the periphery appear reddish on one side and bluish on the other.

With reference to FIG. 5*a*, an embodiment of a ceramic burner 7 of a preferred reflector lamp according to this invention is shown mounted in its outer jacket 9. The ceramic burner 7 has two capillaries 35, 37 which extend outwardly from discharge volume 2. The ceramic burner 7 is sealed within tubular outer jacket 9 by means of press seal 33 and molybdenum foils 32 which act as electrical feedthroughs. The ceramic burner 7 (also referred to as an arc tube or discharge vessel) is made of a polycrystalline alumina (PCA) ceramic, although other translucent/transparent ceramics like sapphire, aluminum nitride, aluminum oxynitride and yttrium aluminum garnet may be used. In an alternate embodiment, the burner may be made of quartz in which case the ends will have press seals similar to the press seal used to seal the outer jacket. The press seals would replace the capillaries of the ceramic burner. In another alternate embodiment, the capillaries of the ceramic burner 7 are located of the same side of the discharge volume (a so-called single-ended arc tube).

The proximal capillary 35 (closest to the press seal 33) which extends outwardly from the proximal side 48 of the discharge volume 2 is electrically connected to lead 43. The distal capillary 37 (farthest from the press seal 33) which extends outwardly from the distal side 49 of the discharge volume 2 is electrically connected to lead 45 by means of return wire 31. A getter flag 41 is attached to return wire 31 to reduce contamination in the outer jacket 9. The discharge volume 2 contains an enclosed chemistry to produce useful light. Such chemistry can be, but is not limited to, a blend of rare earth salts such as halides of Dy, Tm, Ho, with halides of an alkali such as Na and an alkaline earth such as Ca. Iodides are the preferred halides. Other chemistries may be Ce or Pr halides. The salt fill may also contain metallic Hg. The discharge volume also contains an inert buffer gas to permit lamp starting. The gas may be Ar, Kr, Ne or Xe or mixtures thereof, and may be in the cold fill pressure range of 0.004 bar to 15 bar depending on whether the lamp is intended for slow warm-up or more rapid warm-up as an automotive D lamp (typically ~10 bar Xe). Other fill chemistries may be employed and the instant invention is not dependent on the particular fill.

Referring again to FIG. 5*a*, optical element 30 is mounted on distal capillary 37 and close to the discharge volume 2 of ceramic burner 7. In this embodiment, the optical element 30 is a shaped ceramic disk having a central hole that allows the distal capillary 37 to pass through. The optical element 30 is in contact with, but not necessarily attached to, the distal capillary 37. The burner 7 and its outer jacket 9 is mounted in a reflector 20 with the press seal 33 adjacent to reflector base 25 (as illustrated for the prior art lamp shown in FIG. 3*a*). The reflector 20 may be an optic of revolution symmetry around the optic axis. It may also be molded in a non-symmetric shape such as is required for maximum energy transport consistent with principles of non-imaging optics and the laws of thermodynamics.

With reference to FIG. 5*b*, optical element 30 is shaped to reflect or scatter radiation whose angular distribution from the end of the active discharge volume will not impinge on the primary optical control surface of the reflector 20. This region is defined by a solid cone having its vertex at the center of the discharge volume 2 and its base (or directrix) as the open end of reflector 20. The 3-dimensional lateral surface of the cone and the included solid angle $d\Omega$ are shown in a 2-dimensional projection delimited by arrows 10, 11, where $d\Omega=2\pi(1-\cos\theta)$. The light emitted within solid angle $d\Omega$ interacts with the optical element 30 and may be partially reflected towards the reflector 20 (as shown by arrows 50, 51), refracted or scattered in order to better homogenize the light leaving the reflector lamp. The position of the optical element may be maintained by welding the getter flag to the return wire so that the optical element is confined from movement away from the active discharge volume. A separate cross wire may also be welded to the return wire to confine the optical element.

Figures 6A, 6B:
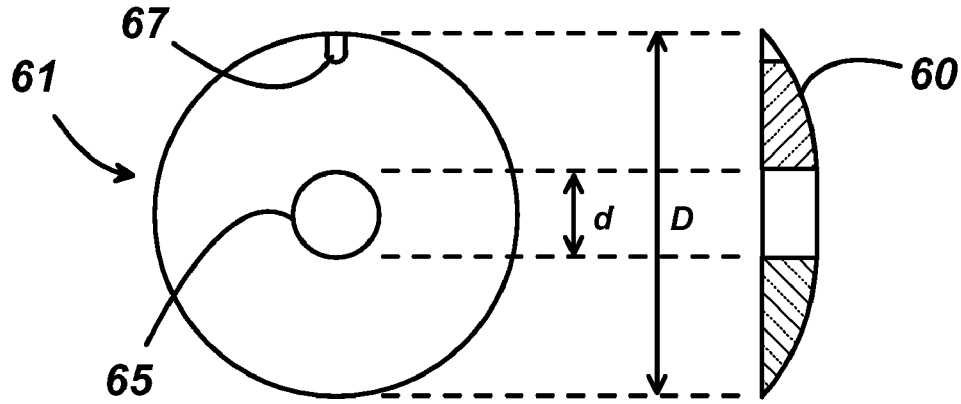
FIGS. 6*a* and 6*b* are front and cross-sectional views, respectively, of a first embodiment of the optical element.

FIGS. 6*a* (front view) and 6*b* (cross-sectional view) illustrate a first embodiment of the optical element. In this case, the optical element 61 is a translucent polycrystalline alumina (PCA) plano-convex shape with a central hole 65 to accommodate the distal capillary. The diameter of the central hole, d, is large enough to pass the capillary, and the outer diameter, D, is small enough to fit inside the outer jacket (typically made of quartz). The hole 65 in the optical element can be a right circular cylinder such as a diamond drill would produce or something more complicated such as a hole with flutes. In the latter configuration, the flutes would be in contact with the capillary to minimize the contact surface area and reduce heat transfer into the optical element and cooling of the capillary. A groove 67 (or an additional off-center hole) is used to accommodate the return wire attached to the distal capillary. The optical element 61 is mounted with its convex surface 60 facing the light emitted from the discharge volume of the burner. This element is designed to scatter the radiation in the isolated solid angle back onto the primary reflector for commingling.

Figures 7A, 7B:
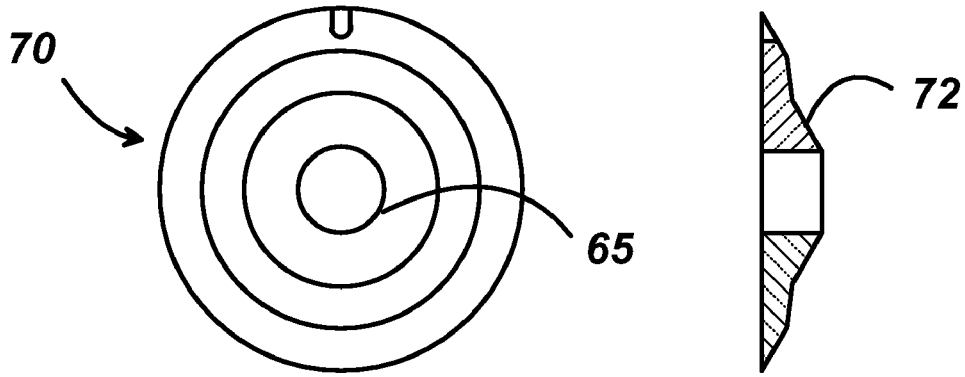
FIGS. 7*a* and 7*b* are front and cross-sectional views, respectively, of a second embodiment of the optical element.

FIGS. 7*a* (front view) and 7*b* (cross-sectional view) illustrate another embodiment of the optical element. Here, the optical element 70 is a faceted, plano-convex shape with a central hole 65 to accommodate the distal capillary. The optical element 70 is mounted with its faceted surface 72 facing the light emitted from the discharge volume of the burner. This element is designed to reflect the radiation in the isolated solid angle back onto the primary reflector for commingling. A metallic or dichroic reflective coating may be applied to the faceted surface 72.

Figures 8A, 8B:
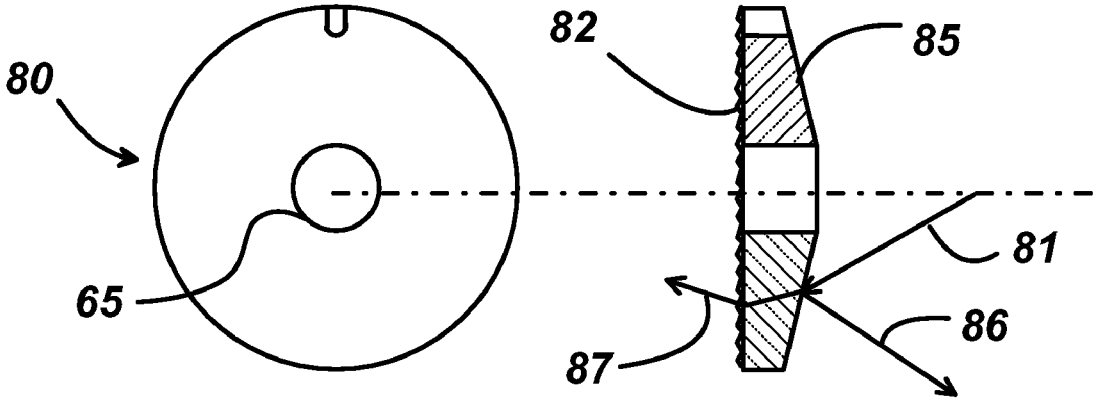
FIGS. 8*a* and 8*b* are front and cross-sectional views, respectively, of a third embodiment of the optical element.

FIGS. 8*a* (front view) and 8*b* (cross-sectional view) illustrate a further embodiment of the optical element. In this embodiment, the optical element 80 is transparent with a faceted surface 85 for refracting the light in the isolated solid angle. The light ray 81 from the burner impinges on the faceted surface 85. A portion of the light 86 is reflected and the greater part 87 is refracted directly into the beam pattern of the primary optical control surface. The rear surface 82 of the optical element 80 is roughened to further scatter the refracted light in transit to the target surface.

While there have been shown and described what are at present considered to be preferred embodiments of the invention, it will be apparent to those skilled in the art that various changes and modifications can be made herein without departing from the scope of the invention as defined by the appended claims.

What is claimed is:

1. A metal halide reflector lamp, comprising: a reflector having a base and an open end opposite the base, a burner having a discharge volume containing a metal halide fill, an outer jacket enclosing the burner and having a press seal with at least one electrical feedthrough, the burner being mounted within the outer jacket, the outer jacket being mounted within the reflector such that the press seal of the outer jacket is adjacent to the base of the reflector, the discharge volume of the burner having a proximal side near the press seal of the outer jacket and a distal side away from the press seal of the outer jacket, an optical element positioned within the outer jacket and mounted to the distal side of the burner, the optical element substantially interacting with light emitted from the discharge volume that is within a solid angle that has its vertex at the center of the discharge volume and is subtended by the open end of the reflector.

2. The lamp of claim 1 wherein the burner is a ceramic burner that has distal and proximal capillaries that extend outwardly from the discharge volume at the distal and proximal sides, respectively, and wherein the distal capillary extends through an opening in the optical element.

3. The lamp of claim 1 wherein the optical element has a plano-convex shape and the convex surface of the optical element faces the discharge volume.

4. The lamp of claim 1 wherein the optical element has a faceted, plano-convex shape and a faceted surface of the optical element faces the discharge volume.

5. The lamp of claim 4 wherein the faceted surface has a reflective coating.

6. The lamp of claim 5 wherein the reflective layer is a metallic or dichroic reflective coating.

7. The lamp of claim 1 wherein the optical element is transparent and has a faceted surface that faces the discharge volume for refracting the light in the solid angle.

8. The lamp of claim 7 wherein the optical element has a roughened surface that faces away from the discharge volume.

9. The lamp of claim 1 wherein the optical element is made of quartz or a ceramic material that is transparent or translucent.

10. The lamp of claim 1 wherein the burner is a ceramic burner comprised of polycrystalline alumina.

11. The lamp of claim 1 wherein the burner is comprised of quartz.

12. The lamp of claim 11 wherein the quartz burner has press seals and one of the press seals passes through the optical element.

13. A ceramic metal halide reflector lamp, comprising: a reflector having a base and an open end opposite the base, a ceramic burner having a discharge volume containing a metal halide fill, a tubular outer jacket enclosing the ceramic burner and having a press seal with at least one electrical feedthrough, the ceramic burner being mounted within the outer jacket, the outer jacket being mounted within the reflector such that the press seal of the outer jacket is adjacent to the base of the reflector, the ceramic burner having a proximal capillary near the press seal of the outer jacket and a distal capillary away from the press seal of the outer jacket, the distal and proximal capillaries extending outwardly from the discharge volume, an optical element comprised of a ceramic material having a disk shape and an opening, the optical element being mounted in the outer jacket with the distal capillary passing through the opening, the optical element substantially interacting with light emitted from the discharge volume that is within a solid angle that has its vertex at the center of the discharge volume and is subtended by the open end of the reflector.

14. The lamp of claim 13 wherein the distal capillary is attached to a return wire that has a getter flag, the getter flag being welded to the return wire and constraining movement of the optical element.

15. The lamp of claim 13 wherein the optical element has a plano-convex shape and the convex surface of the optical element faces the discharge volume.

16. The lamp of claim 13 wherein the optical element has a faceted, plano-convex shape and a faceted surface of the optical element faces the discharge volume.

17. The lamp of claim 16 wherein the faceted surface has a reflective coating.

18. The lamp of claim 17 wherein the reflective layer is a metallic or dichroic reflective coating.

19. The lamp of claim 13 wherein the optical element is transparent and has a faceted surface that faces the discharge volume for refracting the light in the solid angle.

20. The lamp of claim 19 wherein the optical element has a roughened surface that faces away from the discharge volume.

21. The lamp of claim 13 wherein the optical element is made of translucent polycrystalline alumina.

* * * * *